US010548786B2

(12) United States Patent
Hsu

(10) Patent No.: US 10,548,786 B2
(45) Date of Patent: Feb. 4, 2020

(54) HOSPITAL BED

(71) Applicant: Cheng-Hung Hsu, New Taipei (TW)

(72) Inventor: Cheng-Hung Hsu, New Taipei (TW)

( * ) Notice: Subject to any disclaimer, the term of this patent is extended or adjusted under 35 U.S.C. 154(b) by 406 days.

(21) Appl. No.: 15/402,241

(22) Filed: Jan. 10, 2017

(65) Prior Publication Data

US 2018/0193212 A1 Jul. 12, 2018

(51) Int. Cl.
*A61G 7/018* (2006.01)
*A61G 7/05* (2006.01)

(52) U.S. Cl.
CPC ..... *A61G 7/018* (2013.01); *A61G 7/0506* (2013.01); *A61G 7/0507* (2013.01); *A61G 7/0508* (2016.11); *A61G 7/0514* (2016.11)

(58) Field of Classification Search
CPC ..... A61G 7/00; A61G 7/015; A61G 7/018; A61G 7/0506; A61G 7/0507; A61G 7/0508; A61G 7/0514; A61G 7/052
See application file for complete search history.

(56) References Cited

U.S. PATENT DOCUMENTS 2,817,855 A * 12/1957 Pratt ..... A61G 7/0507 5/430
3,081,463 A * 3/1963 Williams ..... A61G 7/002 5/430
3,093,839 A * 6/1963 Higgins ..... A61G 7/0507 5/429
3,248,744 A * 5/1966 Hutt ..... A61G 7/0507 12/142 R
3,855,654 A * 12/1974 Pivacek ..... A61G 7/0507 5/100
3,930,273 A * 1/1976 Stern ..... A61G 7/0507 5/430
3,932,903 A * 1/1976 Adams ..... A61G 7/015 5/100
5,394,581 A * 3/1995 Leoutsakos ..... A47C 21/08 5/662
6,240,583 B1 * 6/2001 Brooke ..... A61G 7/012 5/430
8,307,479 B2 * 11/2012 Wu ..... A61G 7/05 5/600
2013/0160207 A1 * 6/2013 Wu ..... A61G 7/002 5/600

* cited by examiner

*Primary Examiner* — David R Hare
(74) *Attorney, Agent, or Firm* — Chun-Ming Shih; LanyWay IPR Services

(57) ABSTRACT

A hospital bed contains: a body, a headboard, a footboard, a holding frame, at least one peripheral frame, and a drive unit. The headboard is disposed on one of two short peripheries of the body, and the footboard is mounted on the other of the two short peripheries of the body. The holding frame is fixed on the body and includes at least two tabs, and each of the at least one peripheral frame includes a coupling part and two connectors connected with two sides of the coupling part respectively, and each of the two connectors has a movable post, an accommodation stem, and a resilient element fitted on the movable post and moving between the movable post and the at least two tabs. The drive unit is mounted on the holding frame so as to control a rotation angle of the holding frame.

13 Claims, 6 Drawing Sheets

HOSPITAL BED

BACKGROUND OF THE INVENTION

1. Technical Field

The present invention relates to a hospital bed which is fixed and removed easily and saves its packaging cost.

2. Description of Related Art

A conventional hospital bed contains a body, a headboard, a footboard, a holding frame, a connection rod unit configured to move the body upwardly and downwardly, a drive motor configured to adjust a rotation angle of the holding frame, and a protective frame fixed outside of the holding frame.

However, the conventional hospital bed has following defects:

1. As shown in FIG. 9, the protective frame 1 has two T-shaped tubes 3 extending from one end of a main supporter 2 and spanning above the holding frame 4, and the main supporter 2 erects outside the holding frame 4. However, the protective frame 1 has complicate components and a large size. When the hospital bed is not used, the protective frame 1 is removed from the two T-shaped tubes, but two ends of each of the two T-shaped tubes 3 extends over the hospital bed to injure patient easily.

2. The drive motor is packaged by a paper carton before shipping the hospital bed, and then the drive motor is accommodated in another paper carton configured to house the body of the hospital bed, thus increasing packaging cost.

3. As illustrated in FIG. 10, the hospital bed further contains a rotary lever 5 and contains a gear seat 6 configured to drive a head holder 7 and a foot holder 8 to move upwardly and downwardly. Nevertheless, the gear seat 6 cannot connect with the rotary lever 5 stably and securely.

The present invention has arisen to mitigate and/or obviate the afore-described disadvantages.

SUMMARY OF THE INVENTION

The primary objective of the present invention is to provide a hospital bed in which two peripheral frames are fixed on and removed from two long peripheries of a body by way of two connectors easily, and the two connectors are retracted below a holding frame safely.

Further objective of the present invention is to provide a hospital bed in which a motor set is hung on two first fixing rods of a first supporter so as to save packaging cost of the motor set.

Another objective of the present invention is to provide a hospital bed in which a crank lever of each of two control units is fixed in a gear seat of each control unit securely, and when the crank lever is rotated, a hexagonal column of the crank lever contacts with a hexagonal orifice of a gear seat stably.

To obtain the above objectives, a hospital bed provided by the present invention contains: a body, a headboard, a footboard, a holding frame, at least one peripheral frame, and a drive unit.

The body is formed in a rectangle shape.

The headboard is disposed on one of two short peripheries of the body.

The footboard is mounted on the other of the two short peripheries of the body.

The holding frame is fixed on the body and includes at least two tabs secured on a bottom of the body.

Each of the at least one peripheral frame includes a coupling part and two connectors connected with two sides of the coupling part individually, and each of the two connectors has a movable post inserted through the at least two tabs of the holding frame, an accommodation stem connected with the movable post, and a resilient element fitted on the movable post and moving between the movable post and the at least two tabs. When the accommodation stem is upright, it is fixed outside the holding frame, and wherein the two sides of the coupling part are accommodated in the two connectors respectively. When the accommodation stem is pulled outward and the movable post moves outward, the accommodation stem is rotated and is fixed horizontally, and the resilient element pulls the accommodation stem to retract below the holding frame.

The drive unit is mounted on the holding frame so as to control a rotation angle of the holding frame.

DETAILED DESCRIPTION OF THE PREFERRED EMBODIMENTS

Figure 1:
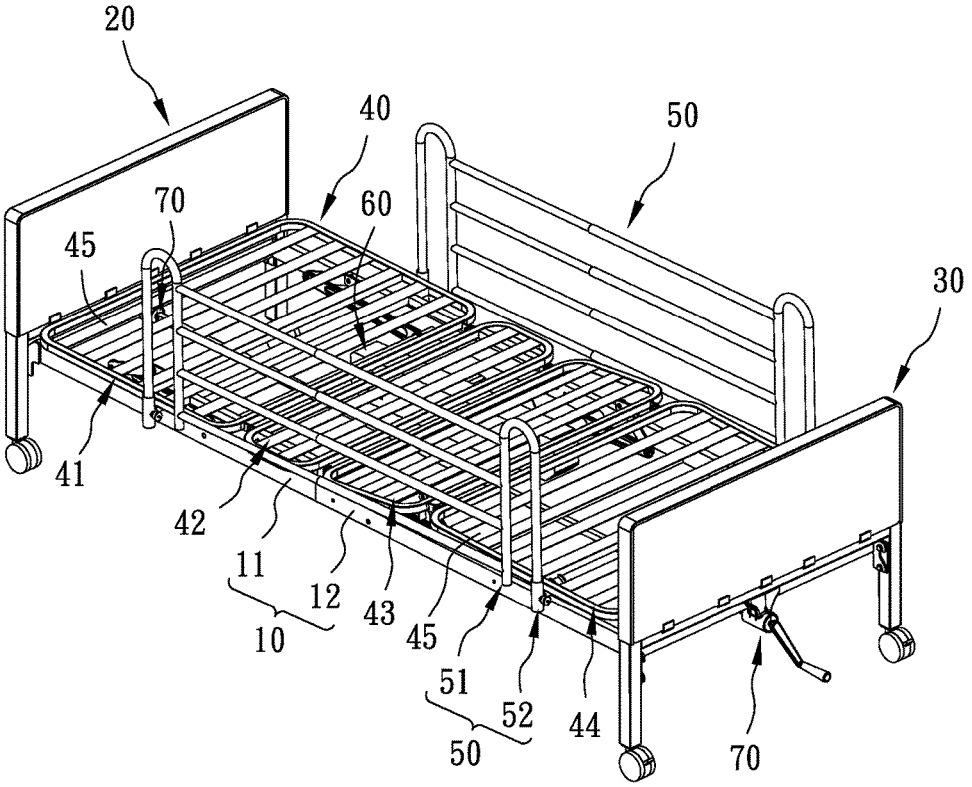
FIG. 1 is a perspective view showing the assembly of a hospital bed according to a preferred embodiment of the present invention.

With reference to FIG. 1, a hospital bed according to a preferred embodiment of the present invention comprises: a body 10, a headboard 20, a footboard 30, a holding frame 40, two peripheral frames 50, and a drive unit 60.

Figure 6:
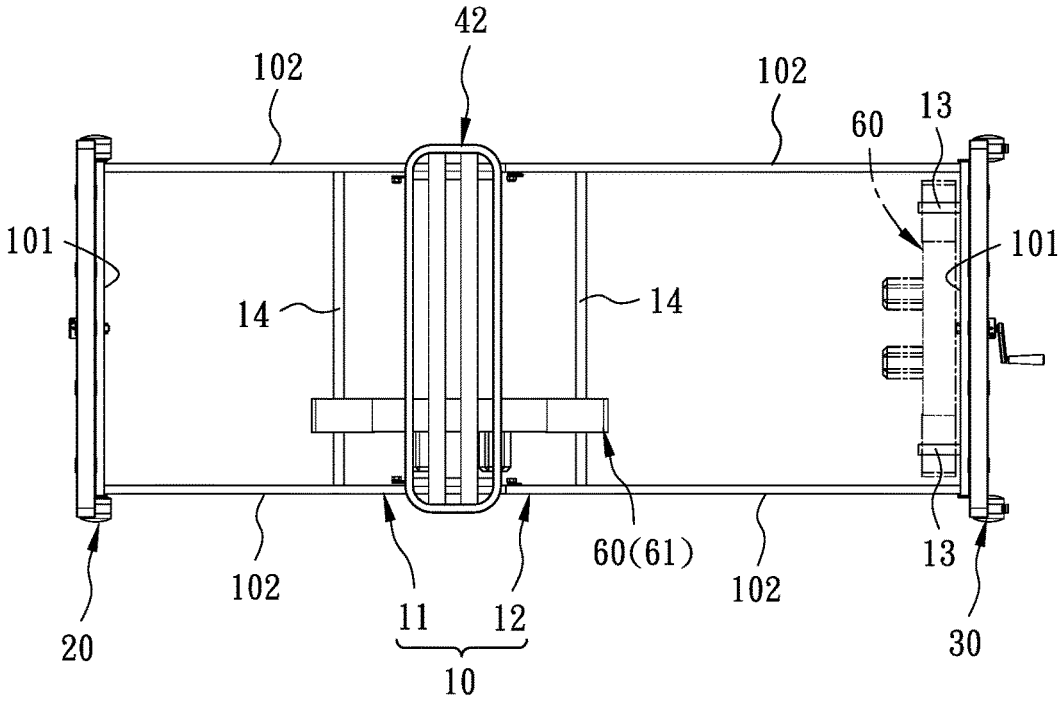
FIG. 6 is a top plane view showing the operation of a drive unit of the hospital bed according to the preferred embodiment of the present invention.

Referring to FIGS. 1 and 6, the body 10 is formed in a rectangle shape and includes a first supporter 11, a second supporter 12 connected with the first supporter 12, and two first fixing rods 13 extending from one of two short peripheries 101 of the body 10 and being parallel to two long peripheries 102 of the body 10 respectively. In this embodiment, the two first rods 13 are located on the first supporter 11.

The body 10 further includes two second fixing rods 14 connected with and between the two long peripheries 102 of the body 10.

The headboard 20 is disposed on an outer wall of the first supporter 11, and the footboard 30 is mounted on an outer wall of the second supporter 12.

Figure 2:
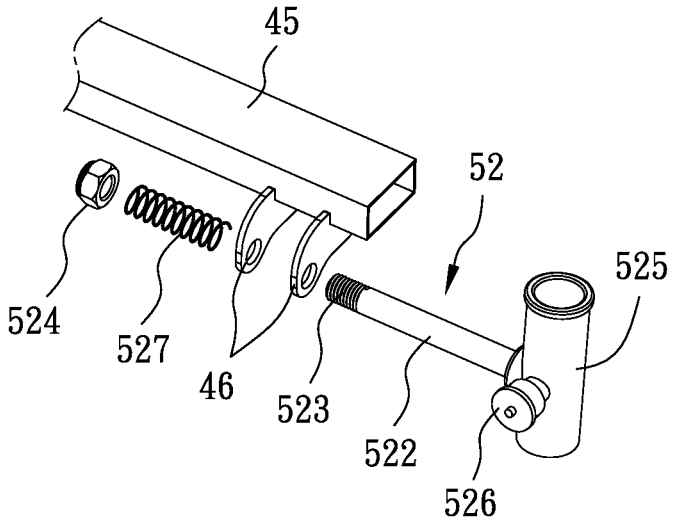
FIG. 2 is a perspective view showing the exploded components of a connector of the hospital bed according to the preferred embodiment of the present invention.

The holding frame 40 is fixed between the headboard 20 and the footboard 30, and the holding frame 40 includes multiple connecting parts 41, 42, 43, 44, multiple reinforcement ribs 45 arranged inside the multiple connecting parts 41, 42, 43, 44 and parallel to the two short peripheries 101 of the body 10, and at least two tabs 46 secured on a bottom of each of the multiple reinforcement ribs 45 (as shown in FIG. 2).

As shown in FIGS. 1 and 2, the two peripheral frames 50 are secured on the two long peripheries 102 of the body 10 respectively, and each of the two peripheral frames 50 includes a coupling part 51 and two connectors 52 connected with two sides of the coupling part 51 individually. Each of the two connectors 52 has a movable post 522 inserted through the at least two tabs 46 of the holding frame 40, a threaded section 523 formed on a first end of the movable post 522, a screwing element 524 screwed with the threaded section 523, an accommodation stem 525 connected with a second end of the movable post 522, an adjustment knob 526 mounted on an outer wall of the accommodation stem 525 and configured to adjust the coupling part 51, and a resilient element 527 fitted on the movable post 522 and moving between the movable post 522 and the at least two tabs 46, hence when the accommodation stem 525 is upright, it is fixed outside the two connecting parts 41, 44 of the holding frame 40 by using the resilient element 527, and wherein the two sides of the coupling part 51 are accommodated in the two connectors 52 respectively, as illustrated in FIG. 1.

Figure 4:
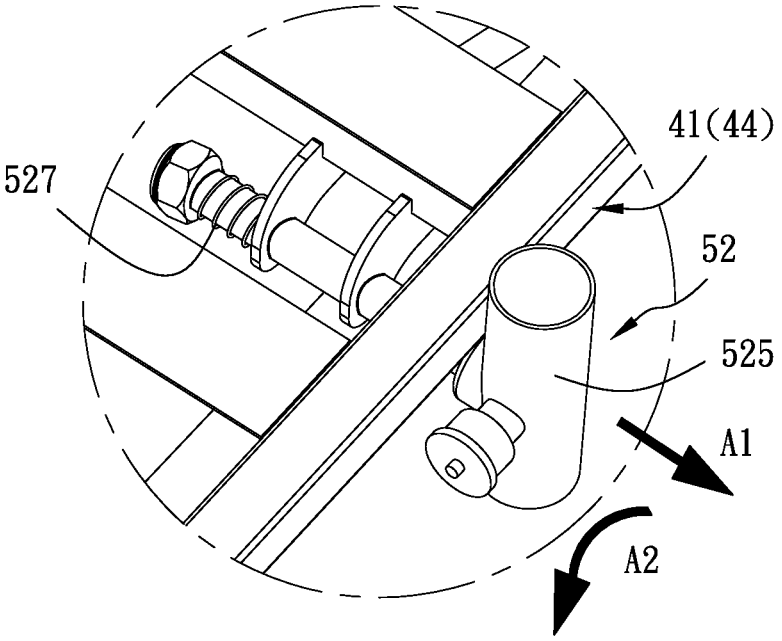
FIG. 4 is a perspective view showing the operation of the connector of the hospital bed according to the preferred embodiment of the present invention.
Figure 5:
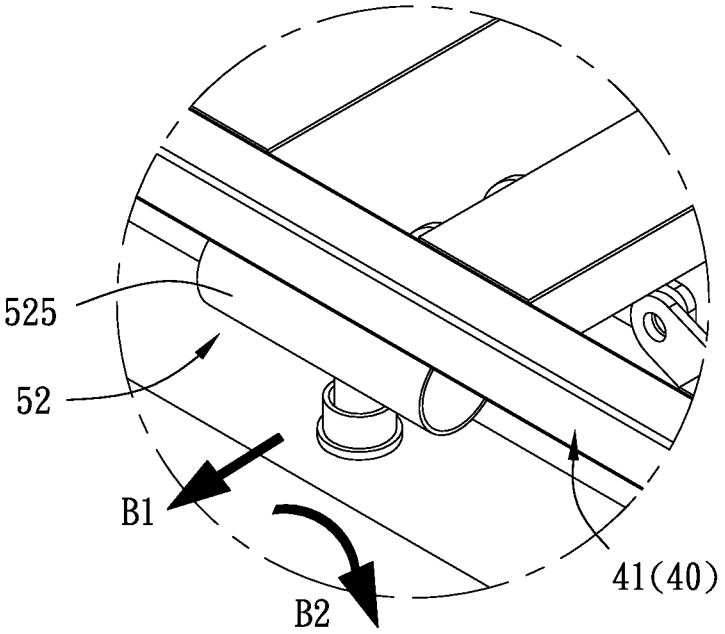
FIG. 5 is another perspective view showing the operation of the connector of the hospital bed according to the preferred embodiment of the present invention.

With reference to FIGS. 4 and 5, when the hospital bed is not used, the two connectors 52 are fixed on the multiple reinforcement ribs 45 of the holding frame 40, and the accommodation stem 525 is retracted below the two connecting parts 41, 44, as shown in FIG. 5. As using the hospital bed, the accommodation stem 525 is pulled outward along a first arrow B1 and is rotated 90 degrees along a second arrow B2. After retracting the resilient element 527 backward, the accommodation stem 525 is upright and is fixed outside the two connecting parts 41, 44 of the holding frame 40, as illustrated in FIG. 4, and the two connectors 52 accommodate the two sides of the coupling part 51 respectively.

As the hospital bed is not used, the coupling part 51 is removed from the two connectors 52, and the resilient element 527 pulls the accommodation stem 525 outward along a third arrow A1 and is rotated 90 degrees along a fourth arrow A2 so that the accommodation stem 525 is horizontal. Thereafter, the resilient element 527 retracts backward, and the accommodation stem 525 is retracted below the two connecting parts 41, 44 safely.

Figure 7:
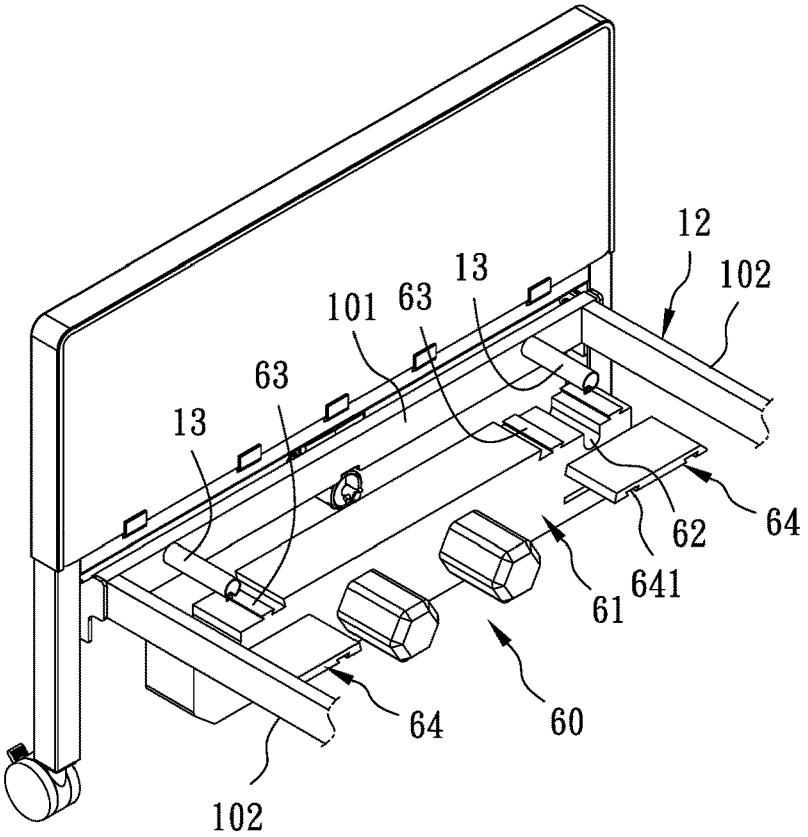
FIG. 7 is a perspective view showing the assembly of a part of the hospital bed according to the preferred embodiment of the present invention.
Figure 8:
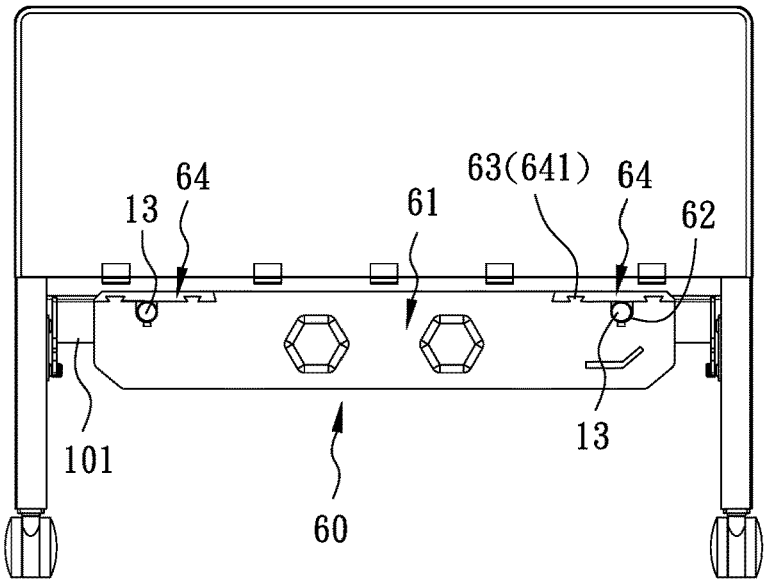
FIG. 8 is a side plane view showing the assembly of a part of the hospital bed according to the preferred embodiment of the present invention.
Figure 9:
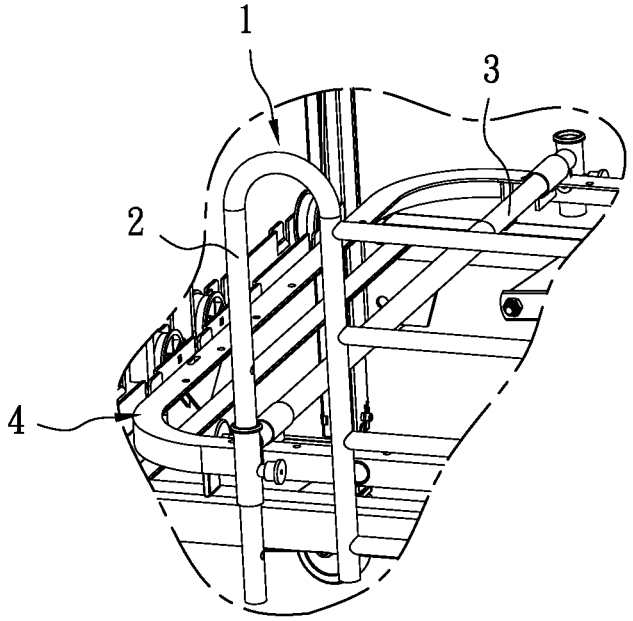
FIG. 9 (Prior Art)
FIG. 9 is a perspective view of a part of a conventional hospital bed.
Figure 10:
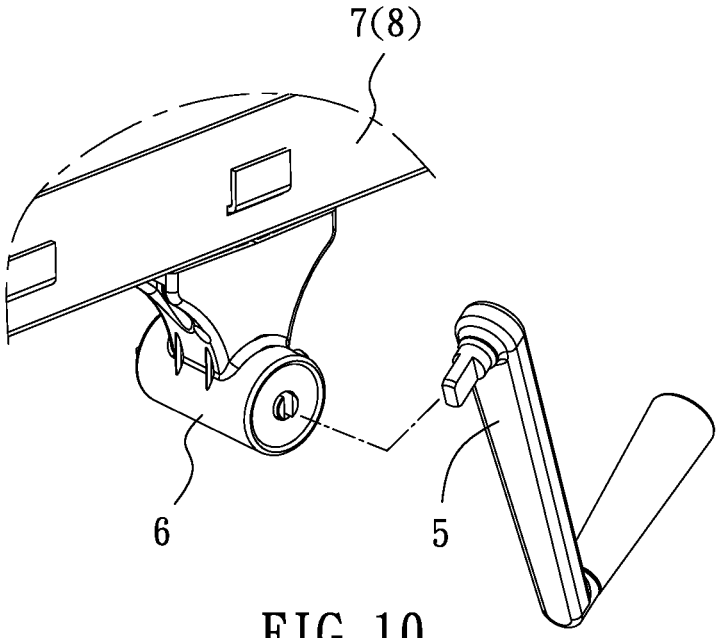
FIG. 10 (Prior Art)
FIG. 10 is another perspective view of a part of the conventional hospital bed.

Referring to FIGS. 6 to 8, the drive unit 60 is configured to control a rotation angle of the holding frame 40, and the drive unit 60 includes a motor set 61, two positioning grooves 62 defined on the motor set 61, two rails 63 arranged on two sides of the two positioning grooves 62 respectively, and two lids 64 sliding on the two rails 63 individually. Each of the two lids 64 has a slideway 641 sliding on each of the two rails 63, wherein one of the two second fixing rods 14 is connected between two long peripheries 102 of the second supporter 12, and the other of the two second fixing rods 14 is connected between the two long peripheries 102 of the first supporter 11. When the motor set 61 is fixed in a using position, as shown in FIG. 6, it controls the multiple connecting parts 41, 42, 43, 44 above the first supporter 11 and the second supporter 12 to swing upward and downward, as illustrated in FIG. 1, so as to adjust the rotation angle of the holding frame 40.

Figure 3:
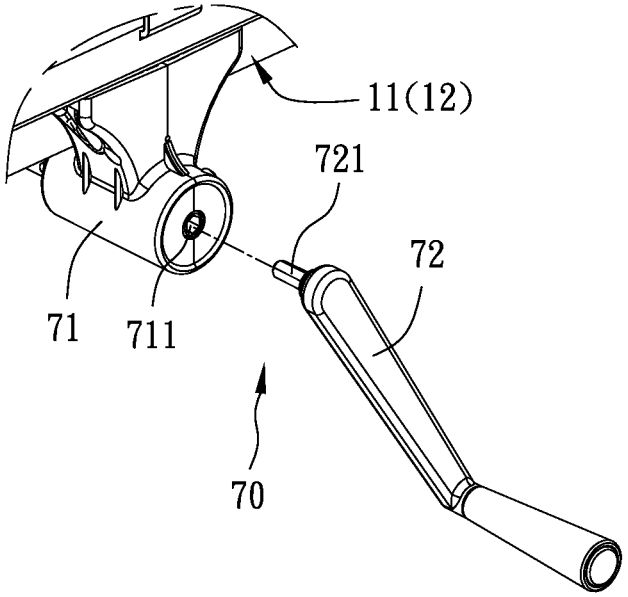
FIG. 3 is a perspective view showing the exploded components of a control unit of the hospital bed according to the preferred embodiment of the present invention.

With reference to FIGS. 1 and 3, the hospital bed further comprises: two control units 70 coupled on the first supporter 11 and the second supporter 12 so as to manually control a rotatable height of the first supporter 11 or the second supporter 12. Each of the two control units 70 includes a gear seat 71 and a crank lever 72, wherein the gear seat 71 has a hexagonal orifice 711, and the crank lever 72 has a hexagonal column 721 fitted into the hexagonal orifice 721 of the gear seat 71.

Accordingly, the hospital bed of the present invention has advantages as follows:

1. The two connectors 52 of each peripheral frame 50 accommodate the two sides of the coupling part 51 respectively and are arranged on the holding frame 40, and the resilient element 527 pulls the accommodation stem 525 outward easily as using the hospital bed. Preferably, the accommodation stem 525 is retracted below the two connecting parts 41, 44 safely, thus avoiding injuring patient.

2. The two first fixing rods 13 are fixed on the first supporter 11, the two second fixing rods 14 are arranged on the first supporter 11 and the second supporter 12 respectively, and the drive unit 60 is mounted on the first supporter 11 as packaging the hospital bed. While using the hospital bed, the drive unit 60 is hung on the two second fixing rods 14 easily so as to save packaging cost.

3. The hexagonal column 721 of the crank lever 72 is housed in the hexagonal orifice 711 of the gear seat 71 so that the crank lever 72 is fixed in the gear seat 71 securely, and when the crank lever 72 is rotated, the hexagonal column 721 contacts with the hexagonal orifice 711 stably.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A hospital bed comprising:

a body formed in a rectangle shape;

a headboard disposed on one of two short peripheries of the body;

a footboard mounted on the other of the two short peripheries of the body;

a holding frame fixed on the body and including at least two tabs secured on a bottom of the body;

at least one peripheral frame, each of the at least one peripheral frame including a coupling part and two connectors connected with two sides of the coupling part individually, and each of the two connectors having a movable post inserted through the at least two tabs of the holding frame, an accommodation stem connected with the movable post, and a resilient element fitted on the movable post and moving between the movable post and the at least two tabs, hence when the accommodation stem is upright, it is fixed outside the holding frame, and wherein the two sides of the coupling part are accommodated in the two connectors respectively; when the accommodation stem is pulled outward and the movable post moves outward, the accommodation stem is rotated and is fixed horizontally, and the resilient element pulls the accommodation stem to retract below the holding frame; and a drive unit mounted on the holding frame so as to control a rotation angle of the holding frame;

wherein the body includes two first fixing rods extending from the one short periphery of the body and being parallel to two long peripheries of the body respectively, the body further includes two second fixing rods connected with and between the two long peripheries of the body; the drive unit includes a motor set, two positioning grooves defined on the motor set, two rails arranged on two sides of the two positioning grooves respectively, and two lids sliding on the two rails individually, wherein when the motor set is fixed on the two first fixing rods by way of the two lids, the drive unit is packaged, and when the motor set is mounted on the two second fixing rods, the drive unit is used.

2. The hospital bed as claimed in claim 1, wherein the body further includes a first supporter and a second supporter connected with the first supporter, and one of the two second fixing rods is connected between the two long peripheries of the first supporter, and the other of the two second fixing rods is connected between the two long peripheries of the second supporter.

3. The hospital bed as claimed in claim 1, wherein each of the two lids of the drive unit has a slideway sliding on each of the two rails.

4. The hospital bed as claimed in claim 1, wherein each connector further has a screwing element screwed with a threaded section of the movable post.

5. The hospital bed as claimed in claim 1, wherein each connector further has an adjustment knob mounted on an outer wall of the accommodation stem.

6. The hospital bed as claimed in claim 1 further comprising two control units coupled on two bottoms of the two short peripheries of the body respectively, and each of the two control units including a gear seat and a crank lever, wherein the gear seat has a hexagonal orifice, and the crank lever has a hexagonal column fitted into the hexagonal orifice of the gear seat.

7. A hospital bed comprising:

a body formed in a rectangle shape and including two first fixing rods extending from one of two short peripheries of the body and being parallel to two long peripheries of the body respectively, and the body also including two second fixing rods connected with and between the two long peripheries of the body;

a headboard disposed on one of the two short peripheries of the body;

a footboard mounted on the other of the two short peripheries of the body;

a holding frame fixed on the body;

at least one peripheral frame, each of the at least one peripheral frame including a coupling part and two connectors connected with two sides of the coupling part individually; and a drive unit configured to control a rotation angle of the holding frame, and the drive unit including a motor set, two positioning grooves defined on the motor set, two rails arranged on two sides of the two positioning grooves respectively, and two lids sliding on the two rails individually, wherein when the motor set is fixed on the two first fixing rods by way of the two lids, the drive unit is packaged, and when the motor set is mounted on the two second fixing rods, the drive unit is used.

8. The hospital bed as claimed in claim 7, wherein each of the two lids of the drive unit has a slideway sliding on each of the two rails.

9. The hospital bed as claimed in claim 7, wherein the body further includes a first supporter and a second supporter connected with the first supporter, and one of the two second fixing rods is connected between the two long peripheries of the first supporter, and the other of the two second fixing rods is connected between the two long peripheries of the second supporter.

10. The hospital bed as claimed in claim 7, wherein the holding frame further includes multiple reinforcement ribs parallel to the two short peripheries of the body, and the holding frame further includes at least two tabs secured on a bottom of each of the multiple reinforcement ribs, wherein each of the two connectors has a movable post inserted through the at least two tabs of the holding frame, an accommodation stem connected with the movable post, and a resilient element fitted on the movable post and moving between the movable post and the at least two tabs, hence when the accommodation stem is upright, it is fixed outside the holding frame by using the resilient element, wherein the two sides of the coupling part are accommodated in the two connectors respectively; and when the accommodation stem is pulled outward and the movable post moves outward, the accommodation stem is rotated and is fixed horizontally, and the resilient element pulls the accommodation stem to retract below the holding frame.

11. The hospital bed as claimed in claim 10, wherein each connector further has a screwing element screwed with a threaded section of the movable post.

12. The hospital bed as claimed in claim 10, wherein each connector further has an adjustment knob mounted on an outer wall of the accommodation stem.

13. The hospital bed as claimed in claim 7 further comprising two control units coupled on two bottoms of the two short peripheries of the body respectively, and each of the two control units including a gear seat and a crank lever, wherein the gear seat has a hexagonal orifice, and the crank lever has a hexagonal column fitted into the hexagonal orifice of the gear seat.

* * * * *